US006684430B2

(12) United States Patent
Roux

(10) Patent No.: US 6,684,430 B2
(45) **Date of Patent: *Feb. 3, 2004**

(54) SUPPORT FOR EXPANSIBLE CELLS

(76) Inventor: Georges M. Roux, Mas de la Sauvagine, Montcalm, F-30220 Aigues Mortes (FR)

( * ) Notice: Subject to any disclaimer, the term of this patent is extended or adjusted under 35 U.S.C. 154(b) by 0 days.

This patent is subject to a terminal disclaimer.

(21) Appl. No.: 10/302,741

(22) Filed: Nov. 22, 2002

(65) Prior Publication Data

US 2003/0131417 A1 Jul. 17, 2003

Related U.S. Application Data

(63) Continuation of application No. 08/969,666, filed on Nov. 13, 1997, now Pat. No. 6,550,085, which is a continuation of application No. PCT/FR97/01112, filed on Jun. 23, 1997.

(51) Int. Cl.[7] ..... A47C 27/08
(52) U.S. Cl. ..... 5/654; 5/655.3; 5/944
(58) Field of Search ..... 5/652, 654, 655.3, 5/706, 710, 944

(56) References Cited

U.S. PATENT DOCUMENTS

| | | | | |
|---|---|---|---|---|
| D35,558 | S | 1/1902 | Kiefer | D9/545 |
| 3,605,145 | A | 9/1971 | Graebe | 5/706 |
| 3,870,450 | A | 3/1975 | Graebe | 425/269 |

(List continued on next page.)

FOREIGN PATENT DOCUMENTS

| | | |
|---|---|---|
| DE | G 94 10 601.0 | 9/1994 |
| EP | 0 651 162 B1 | 8/1997 |
| EP | 0 566 507 B1 | 11/1998 |
| EP | 0 651 959 B1 | 12/1998 |
| FR | 2599249 | 5/1986 |
| FR | 2707873 | 7/1993 |
| FR | 2736812 | 7/1995 |
| GB | 1341325 | 12/1973 |
| JP | 3-39205 | 2/1991 |
| JP | 4-30813 | 2/1992 |
| JP | 4-30814 | 2/1992 |
| JP | 5-81423 | 4/1993 |
| JP | 7-257 | 1/1995 |
| WO | WO 93/00845 | 1/1993 |
| WO | WO 93/16622 | 9/1993 |
| WO | WO 93/16940 | 9/1993 |
| WO | WO 93/24089 | 12/1993 |
| WO | WO 94/19998 | 9/1994 |
| WO | WO 96/08185 | 3/1996 |
| WO | WO 96/12426 | 5/1996 |
| WO | WO 96/14004 | 5/1996 |
| WO | WO 96/33686 | 10/1996 |

*Primary Examiner*—Robert G. Santos
(74) *Attorney, Agent, or Firm*—Brinks Hofer Gilson Lione

(57) ABSTRACT

Support or padding including expandable cells whose cell body in its resting state seen in transverse section is individually delimited by at least two concentric perimeters, the walls of the cell in its resting state rejoining each of the perimeters are characterized by the fact that the portion of the wall of the cell rejoining two points located ach on one of the concentric perimeters 6 and 7 can be strictly in a straight line during its centripetal path, if between two other points 28 at the entrance of the successive fissures, slits or cells 4 located on the external perimeter 7 of the path followed takes at least for a certain length an aspect strictly of a straight line or flat part 29, one of the lat two points 28 being the same as the first one located on the external perimeter 7 at the junction or exit of a fissure: all of the consecutive points of the is flat part 29 being further away or distal in relation to the center 24 of the cell than the other points, outside of the flat part 29, constrictive of the sheath 7 on its path between two points 28 located at the junction of the successive fissures 4.

13 Claims, 4 Drawing Sheets

U.S. PATENT DOCUMENTS

Figure 1:
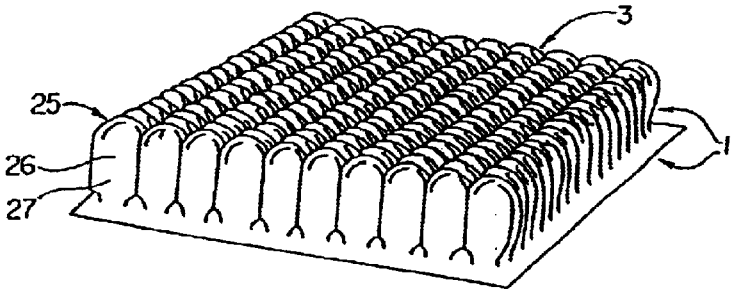

| | | | | |
|---|---|---|---|---|
| 4,005,236 | A | 1/1977 | Graebe | 428/72 |
| 4,005,603 | A | 2/1977 | Golahny et al. | 73/861.03 |
| 4,279,044 | A | 7/1981 | Douglas | 5/714 |
| 4,422,194 | A | 12/1983 | Viesturs et al. | 5/686 |
| 4,541,136 | A | 9/1985 | Graebe | 5/706 X |
| 4,698,864 | A | 10/1987 | Graebe | 5/654 |
| 4,726,624 | A | 2/1988 | Jay | 297/452.25 |
| 4,864,671 | A | 9/1989 | Evans | 5/713 |
| 4,953,913 | A | 9/1990 | Graebe | 297/452.25 |
| 5,018,790 | A | 5/1991 | Jay | 297/452.26 |
| 5,052,068 | A | 10/1991 | Graebe | 5/655.3 X |
| 5,163,196 | A | 11/1992 | Graebe et al. | 5/944 X |
| 5,243,722 | A | 9/1993 | Gusakov | 5/655.3 |
| D342,411 | S | 12/1993 | Graebe | D6/601 |
| 5,369,828 | A | 12/1994 | Graebe | 5/654 |
| 5,369,829 | A | 12/1994 | Jay | 5/654 |
| D355,558 | S | 2/1995 | Graebe | 5/654 X |
| 5,437,936 | A | 8/1995 | Johnson | 428/593 |
| 5,487,197 | A | 1/1996 | Iskra, Jr. et al. | 5/654 |
| D367,199 | S | 2/1996 | Graebe | D6/601 |
| 5,502,855 | A | 4/1996 | Graebe | 5/944 X |
| 5,533,220 | A | 7/1996 | Sebag et al. | 5/654 |
| 5,551,107 | A | 9/1996 | Graebe | 5/654 |
| 5,553,220 | A | 9/1996 | Keene | 345/520 |
| 5,561,875 | A | 10/1996 | Graebe | 5/423 |
| 5,609,288 | A | 3/1997 | Johnson | 228/157 |
| 6,317,912 | B1 | 11/2001 | Graebe et al. | 5/710 |
| 6,321,404 | B1 | 11/2001 | Tsai | 5/655.3 |
| 6,510,573 | B1 * | 1/2003 | Grabe | 5/655.3 X |
| 6,550,085 | B2 * | 4/2003 | Roux | 5/654 |
| 6,564,410 | B2 * | 5/2003 | Graebe et al. | 5/710 |
| 2002/0013967 | A1 * | 2/2002 | Roux | 5/654 |
| 2002/0066143 | A1 * | 6/2002 | Graebe et al. | 5/710 |
| 2003/0110565 | A1 * | 6/2003 | Grabe | 5/655.3 X |
| 2003/0131417 | A1 * | 7/2003 | Roux | 5/654 |

* cited by examiner

SUPPORT FOR EXPANSIBLE CELLS

This application is a continuation of application Ser. No. 08/969,666 now U.S. Pat. No. 6,550,085, filed Nov. 13, 1997 (pending), which is a continuation of and is herein incorporated by reference and which claims foreign priority under 35 U.S.C. §119(a)–(d) or 356(b) of Patent Cooperation Treaty Application PCT/FR 97/01112, filed Jun. 23, 1997, for Rembourrage Ou Support A Cellules Expansibles.

INVENTION SUMMARY

The present invention pertains to a support material that can serve as mattress, cushion or padding and is made of small balloon shaped cells filled with a fluid. These cells are interconnected at their base in order to create a single volume of fluid which fills all the cells, the type of fluid being selected according to the application. The cell layout is designed to yield the lowest possible cell density (number of cells per unit of area of the support) while offering a supporting surface as uniform as possible and capable of closely conforming to the contour of the supported body once they are filled.

This support material can be used in the medical field, for mattresses and cushions designed to prevent bed sores or for protective padding, such as those present in dorsolumbar supports or to protect fragile equipment.

BACKGROUND OF THE INVENTION

These types of support material are already known in terms of the ability of their bearing surface to conform to the supported body while presenting the same reaction regardless of the degree of compression of the support, due to the pressure equalization among the interconnected cells. This is described by JAY in U.S. Pat. No. 47,266,624, U.S. Pat. No. 5,018,790 and U.S. Pat. No. 5,369,829 relating to cushions, where a sheath made of several oversized sheets assembled in the same plane is filled with gel and placed on a shaped seat of smaller dimensions. This case sheaths contains longitudinal and transverse chambers which are interconnected in such a manner that when someone is sitting, the pressure is equalized among the various chambers. In position, the sheath can be perceived as an array of longitudinal and transverse cylindrical balloons which are elevated above the median plane of the seam of the sheath, the disadvantage being the presence of numerous folds which could constrict the blood circulation in the skin.

We know the bed described by HINSDALE in U.S. Pat. No. 945,234, whose mattress is made of a staggered array of small spherical balloons, the top of these being the bearing surface characterized by the most uniform pressure over the entire supporting area. The balloons are inflated with air, circulation of which is possible, and they are all interconnected at their bottom via a network of tubes, thus creating a single air chamber where each balloon sees the same air pressure.

In WO 96/08185, Ouiger describes how a compensation chamber regulates the pressure within an air mattress. In EP 0651 959A1, Todter describes a bellow type of cellular support. In EP 0651 162A2, Kawasaki describes a cellular support made of non-expansible square cells located on either side (top and bottom) of the seam plane, with cross braces where the rows intersect. Iskra, in U.S. Pat. No. 5,487,197 describes a controlled support with non-expansible longitudinal inflatable cells. In WO 96/19997, Holdredge describes a support equipped with a turbine, which includes non-expansible inflatable bladders. Caldwell in WO 93/24089, Johnson in WO 94/19998 (U.S. Pat. No. 5,373,595) and Evans in WO 95/15706 describe controlled supports with elongated inflatable bladders. In EP 0566 507A1, Beaud describes a support consisting of inflatable elements made of two sheets, with an internal wall on the seam plane of the two sheets. In JP 07000257, Yamamoto Giichi describes a vibration absorbing cushion designed for vehicle drivers. In JP 04030814 and JP 04030813, Sagami Masaharu describes the behavior of a inflatable cell mattress. In JP 03039105, Hiochi Toshimichi describes the flow regulation (air or water) within a support. Supports which rely on regulation or dynamic assistance have one disadvantage which is their cost. Without objecting to a possible usage of assisted supports, the present invention provides a support which does not need any type assistance to operate, like some previously mentioned supports from HINSDALE, GRAEBE, BENGUIGUI or VIESTURS. In addition, some medical supports have a disadvantage in that they favor the "hammock effect" which contributes to a shearing of the skin and hinders blood circulation. For instance, in the case of the Hinsdale product used to prevent bed sores, this undesirable effect can be avoided by removing the upper fabric layer or by replacing it with a highly extensible fabric such as jersey.

Patent GB 1341325 describes a mattress somewhat similar in principle, which is inflated with a turbine, also described by DOUGLAS in U.S. Pat. No. 4,279,044.

Patent JP 05081423, by Ichida Michiyasu describes a regulation system in a mattress consisting of truncated conical cells.

Such supports can be improved by using small balloons or conical cells described by GRAEBE in U.S. Pat. No. 3,605,145, which are interconnected via small ducts at the bottom of the cells, these ducts appearing automatically when the sheets are assembled together. GRAEBE then goes on to describe cells whose cross section is in the shape of a star, in which the walls of the inflated balloons can expand beyond the position and volume they occupy when deflated. It is therefore possible to arrange these cells or balloons upright on their bottom in longitudinal or transverse rows while maintaining a uniform bearing surface upon inflation, which would not be the case with the balloons described by HINSDALE in U.S. Pat. No. 945,234 if they were arranged in the same configuration. The GRAEBE invention pertaining to the cell expansion led in 1975 and 1977 to the U.S. Pat. Nos. 3,870,450 and 4,005,236, in which he details the mold required to manufacture a support and describes the resulting support identical in nature to the previous one in U.S. Pat. No. 3,605,145, and characterized by the expansion and interconnection of the cells via bottom ducts created by the assembly of the two sheets, the upper sheet being shaped, the lower sheet being flat, such as he also describes in the US design Pat. No. D35558. The deflated cells can be contained within a virtual sheath having a round, square, rectangular cross section and they can be uniform or not from top to bottom, with or without a foot (U.S. Pat. No. 3,605,145 and U.S. Pat. No. 3,870,450), as also indicated by EVANS in U.S. Pat. No. 4,864,671, the type of inflating fluid being irrelevant. The interconnecting system between cells filled with a liquid has also been described by VIESTURS in U.S. Pat. No. 4,422,194, for a cellular support presenting a square cross-section and resulting from the assembly of formed sheets located on either side of the seam plane. SEBAG and BENGUIGUI in U.S. Pat. No. 5,553,220 (EP 0721755A1) describe an alternate cellular design with four branches or ribs having parallel sides. The lateral concavities in the contiguous cells facing each other, they basically reproduce the description of the distribution grid in FR 270873.

In DE-U-9410601, ROUSCHAL describes some cells but focuses mostly on a cell interconnecting network obtained by gluing the formed top sheet and the flat bottom sheet around the perimeter of the support only.

In U.S. Pat. No. 4,541,136, GRAEBE also described a simple cell shape having only four branches, such as half the deflated bladder of a pigskin football, the cross-section of which has the shape of a cross, the four branches of the star or cross of GRAEBE ending at the four corners of a square. In the previous art, the two side walls or faces of the ridges of the mandrel and therefore of the ridges of the cells also are relatively close and parallel: U.S. Pat. No. 4,005,236 (Col. 3, line 13—radially directed ribs) and U.S. Pat. No. 4,541,136 (claim 2: pair of closely spaced side walls). In U.S. Pat. No. 4,864,671, EVANS call these ribs "ridges" and the cell side walls "folds" where GRAEBE in U.S. Pat. No. 4,541,136 instead uses "depressed side walls". Furthermore, in U.S. Pat. No. 4,005,603 and U.S. Pat. No. 5,052,068, Graebe gives a broad description of cells of various cross-sections, which does not detail the various rib shapes except in terms of their radial configuration in U.S. Pat. No. 4,005,236 and their two parallel side walls in U.S. Pat. No. 4,541,136 as previously indicated. As we shall see in the description of this invention, its distinction and advantage are also demonstrated by comparing the shapes of the ribs with two side walls from the previous art with the shape of the ribs in this invention. Not taking into account the supposedly different mechanical properties of the multi-branched or multi-ribbed cells previously described by GRAEBE, this simple shape makes it much easier to fabricate the male mandrels required to manufacture the cells. The mandrels can be cast between two dies, the seam between the dies lying in the cell sagittal axis. The two-die casting process can be applied to any product except aluminum. Each die, preferably a metal die, casts a full branch or rib of the mandrel and a side wall of two contiguous branches, as in the cell described in U.S. Pat. No. 5,553,220, in which case the "seam plane" of the two dies is not a plane but rather takes the form of a "Z", thus avoiding the sand casting of mandrels, often made in aluminum, which is required to produce supports such as cushions. This four branched star shape is the only one allowing a one-piece dipping mandrel manufactured using two rigid dies. Indeed, to create a three branch cell, three dies are needed, and for a five branch cell, five dies. The sand casting of aluminum mandrels is inexpensive, but the resulting surface is rough. Some lost wax casting processes are ideal but expensive. Machining the cell mandrels is a very expensive proposition. The casting of a complete cell mandrel (top, body, base) can be done in one piece using flexible elastomer molds: it is also possible to extrude the body and assemble it to the top and the base, the interconnection of the cells being achieved using the description which is in the public domain. Based on the same principle of pressure equalization, GRAEBE has filed U.S. Pat. No. 4,698,864, the application WO 94/10881, U.S. Pat. No. 5,163,196 and U.S. Pat. No. 5,502,855. In U.S. Pat. No. 5,369,828, and in U.S. Pat. Nos. 5,551,107 and 5,561,875 as well, GRAEBE describes non-expansible pyramid shaped cells; but also in WO 93/16622 which describes a cell cushion having a formed seating surface, in WO 96/12426 in which the cells are produced by thermoforming and in WO 96/14004 which presents an adaptable seating surface. Graebe has originally described a square cell support in U.S. Pat. No. 5,152,023. With the same intent as JAY, previously mentioned for three of his numerous patents, GRAEBE has described cushions with interconnected cells and/or their seating surface in U.S. Pat. No. 4,953,913, in application PCT/US/9310626 published on May 26, 1994 (water filled foam base), in D342411 an D367199. In U.S. Pat. No. 4,864,671, EVANS describes cells in the shape of a Christmas tree and which can expand like an accordion having a square cross section. In WO 96/33686, BOSSHARD describes a support made of inflated cells filled with fluid, with a pressure sensing device for safety. Another cushion based on the pressure equalization principle which has been known for some time is sold under the name "DOMINO" by CHINESPORT of UDINE, Italy, part of their "antidecubio" product line. It features cells made of four cylinders, which are half spherical at the top (bearing surface) and rigidly attached in groups of fours to create a non-expansible cell. The resulting cushion, according to the brochures, effectively combats motion sickness by restricting the lateral movements of the cells.

In the application PCT/DK93/00069 published on Sep. 2, 1993, RASMUSSEN describes a packaging component made out of plant fibers which seems to be economical, but cannot be reused. In WO 93/00845, COLVIN describes a dampening composite structure consisting of truncated or polygonal air cells that is reusable.

In U.S. Pat. No. 5,243,722, GUSAKOV describes an assembly of fluid filled cells which is symmetrical with respect to the median seam plane.

In FR 2599249, BEL describes air support elements consisting of small non-expansible balloons, grouped in clusters, a configuration which has for the licensed company, Coram, the disadvantage of expressly requiring a special case to maintain the clusters in place.

These various supports have the following major disadvantages: either it is impossible to expand the cells beyond their deflated volume, which requires them to be staggered; or they leave voids in longitudinal and transverse arrays of non-expansible cells or cells whose expansion is limited by the cell perimeter in the case of the GRAEBE supports, or even further limited at the angles if the cells have four branches ending at the four corners of a square; or a relatively complex description of poorly defined cells.

Finally, in the French application 95/08972, ROUX has described a cellular support made of interconnected cells whose major disadvantage is the total lack of information concerning the multi-ribbed cells and the small size cells, which is annoying since all the sharp angles discussed later herein have to be rounded for practical considerations. Furthermore, as it shall be described later in this document, the nature of this invention allows us to describe its advantages and differences in relation to uncommonly shaped cells, left out by GRAEBE in U.S. Pat. No. 4,005,236 and U.S. Pat. No. 5,052,068.

The present invention attempts to remedy the problems associated with the previous art.

As a result, this invention pertains to mattresses, cushions, padding for medical use, reusable packaging for fragile items, dampening supports constructed with expansible cells, all featuring an upper sheet, usually formed and flexible, and interconnected expansible cells, which expand when filled with a fluid. The cross section of a cell in its natural state (deflated/empty), taken in the cell body, is delimited by at least two perimeters, an inner and an outer, which are partially virtual, concentric and located on geometric figures (envelopes) of miscellaneous shapes, i.e. square, pentagonal, octagonal, circular, irregular. The slits, cracks or crevices consisting mostly of side walls, more or less closely spaced, and parallel or not, with draft or against draft: straight, concave, convex or jagged lines connecting the outer perimeter to the inner perimeter. The use of jagged lines to connect the perimeter to the center area of the balloon or cell offers a definite advantage in that the part of the side wall of the cell which connects points located on different perimeters can actually be a straight line.

DESCRIPTION OF THE INVENTION

Other characteristics and advantages of this invention shall become clear with the following description as well as with the sketches found in the appendix, designed to illustrate various possible configurations with no limitative intent. To simplify, we shall consider that the lines appearing on the cross-sections represent the cell material. In order to take into account the known descriptions arising out of the previous art, the spaces that are contained within these lines can be assumed to represent male mandrels or molds. The spaces which are outside the lines can be assumed to represent female molds. The dotted lines as well as the dots indicating the longitudinal axes do not represent any material. They are used to show the boundaries of the partially virtual envelopes, most often in the description relating to the cell body, or to locate the cell with respect to its longitudinal axis. When the description refers to a cell in its natural state, we mean a cell whose position and shape are identical to those of the cell still in the mold prior to its release. Therefore, a cell can be in its natural state when the support is being assembled. In a completed support, a cell in its natural state shall be assumed filled with a fluid, the volume of which is equal to the volume of the male mandrel used to manufacture the cell, and not subjected to any external mechanical strain, except the ambient pressure.

FIG. 1 is a bird's eye view of an upper sheet made of roughly identical expansible cells, such as those shown on FIGS. 6, 7, 9, 10 and 11.

Figure 2:
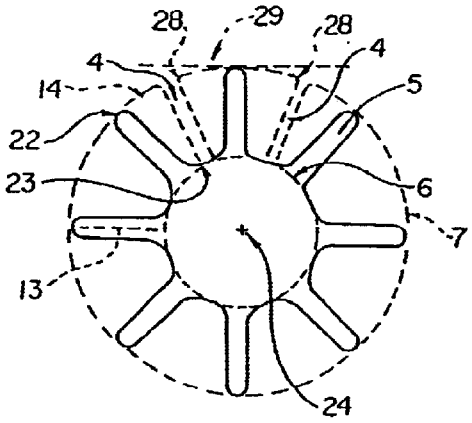

FIG. 2: Cross section of the side walls of the body of a cell in its natural state, in the shape of an eight branch star.

Figure 3:
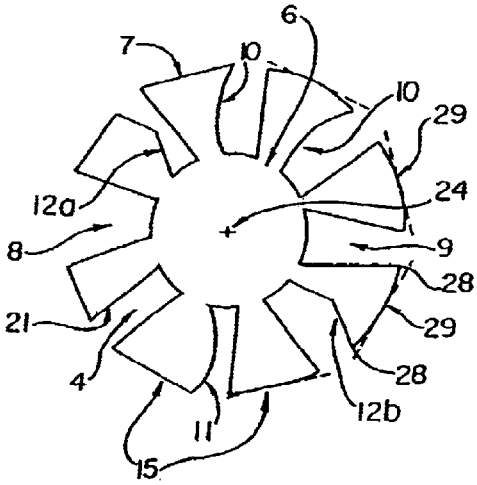

FIG. 3: Cross section of the side walls of the body of a cell in its natural state whose external envelope is roughly circular and about octagonal, with eight randomly distributed crevices of various shapes and at least as many flat segments as there are crevices on the outer perimeter.

Figure 4A:
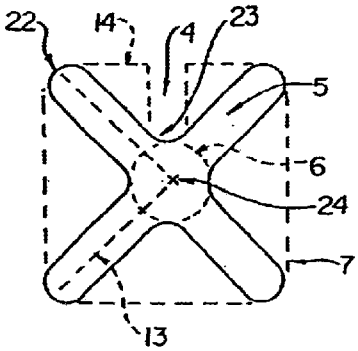

FIG. 4*a*: Cross section of the side walls of the body of a cell in its natural state with four branches ending at the four corners of a square, mostly derived from the previous art.

Figure 4B:
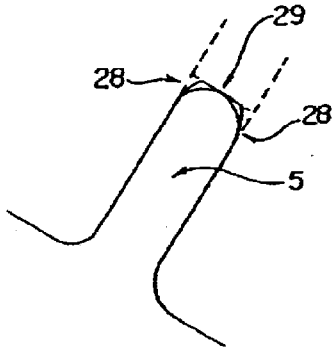

FIG. 4*b*: Detail of a rib of an expansible cell according to the previous art and the current invention.

Figure 5:
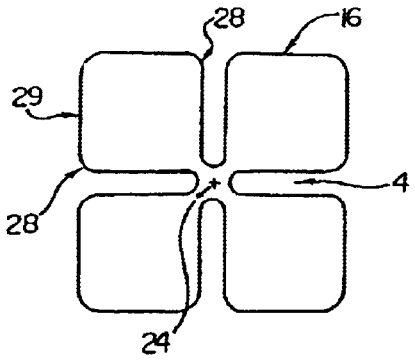

FIG. 5: Cross section of the side walls of the body of a cell in its natural state whose external envelope is roughly square, featuring four crevices on the sides of the square and at least as many flat segments on the outer perimeter.

Figure 6:
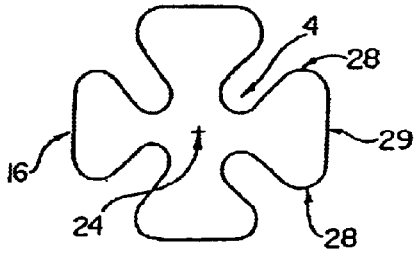

FIG. 6: Cross section of the side walls of the body of a cell in its natural state whose external envelope is roughly square, featuring four diagonal crevices and at least as many flat segments on the outer perimeter.

Figure 7:
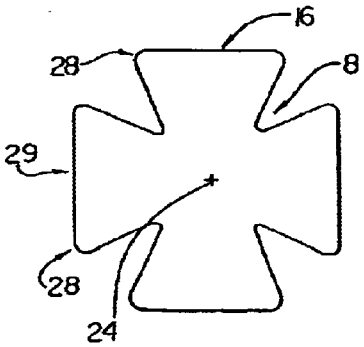

FIG. 7: Cross section of the side walls of the body of a cell in its natural state whose external envelope is roughly square, featuring four diagonal crevices, the walls of these crevices being not parallel and the crevices being larger at the distal end of the cell or draft and featuring at least as many flat segments as there are crevices on the outer perimeter.

Figure 8:
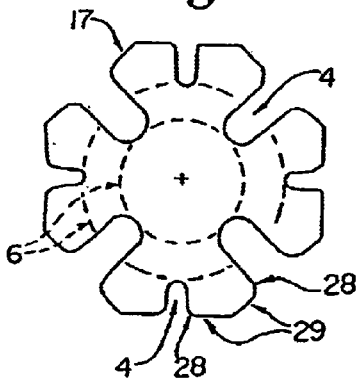

FIG. 8: Cross section of the side walls of the body of a cell in its natural state whose external envelope is roughly octagonal, featuring eight crevices on the eight faces of the octagon and two concentric inner perimeters, and having at least as many flat segments on the outer perimeter as there are crevices.

Figure 9:
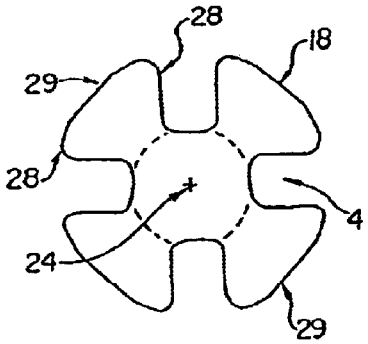

FIG. 9: Cross section of the side walls of the body of a cell in its natural state whose external envelope is roughly circular, featuring four crevices and having at least as many flat segments on the outer perimeter as there are crevices.

Figure 10:
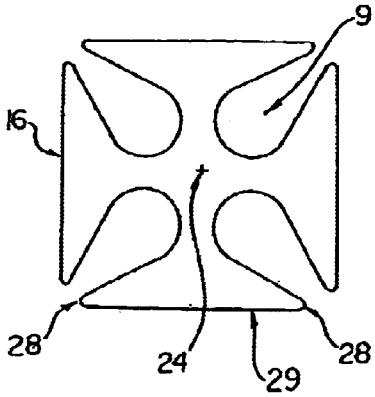

FIG. 10: Cross section of the side walls of the body of a cell in its natural state whose external envelope is roughly square, featuring four diagonal crevices whose walls are not parallel, the crevices being larger towards the center of the cell or against draft, and having at least as many flat segments on the outer perimeter as there are crevices.

Figure 11:
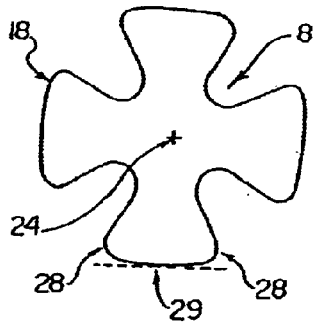

FIG. 11: Cross section of the side walls of the body of a cell in its natural state whose external envelope is roughly circular, featuring four crevices with draft and at least as many flat segments on the outer perimeter as there are crevices.

Figure 12:
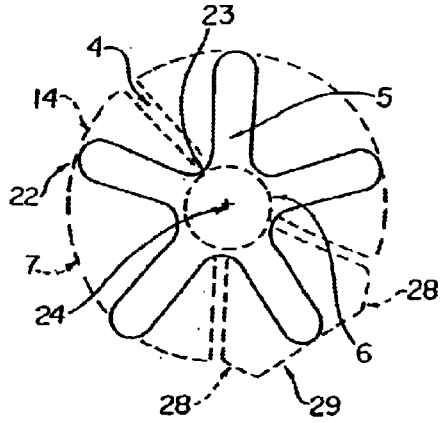

FIG. 12: Cross section of the side walls of the body of a cell in its natural state in the shape of a five branch star, each branch ending at the corners of a pentagon.

Figure 13:
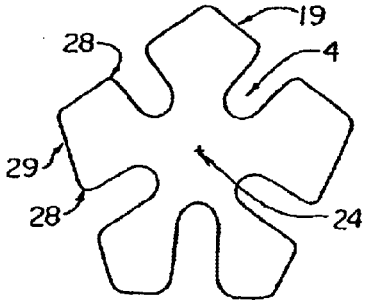

FIG. 13: Cross section of the side walls of the body of a cell in its natural state whose external envelope is roughly pentagonal, featuring five crevices on the five sides of the pentagon and as many flat segments on the outer perimeter as there are crevices.

Figure 14:
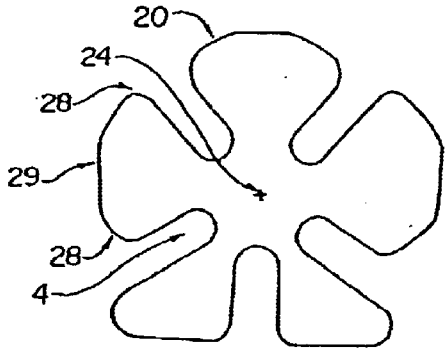

FIG. 14: Cross section of the side walls of the body of a cell in its natural state whose external envelope is roughly pentagonal, featuring five crevices on the five sides of the pentagon, three sides being curved, continuous on three sections between four of the crevices, the two other sides being flat, and having at least as many flat segments on the outer perimeter as there are crevices.

Figure 15A:
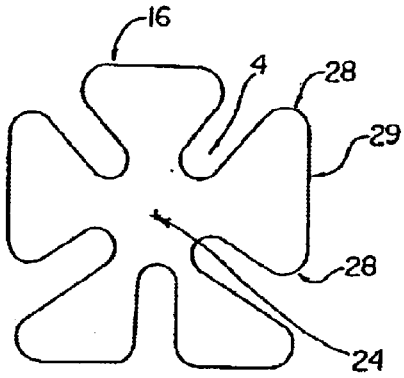

FIG. 15*a*: Cross section of the side walls of the body of a cell in its natural state whose external envelope is roughly square, featuring five crevices, two crevices being located on the half diagonal lines of the square, at the end points of a given side, one crevice being located at the midpoint of the side opposite to the side between the two crevices on the half diagonal lines, the last two crevices being located on the outer envelope, roughly at the two-third point on the last two sides, between the first three crevices, and said cell featuring at least as many flat segments on the outer perimeter as there are crevices.

Figure 15B:
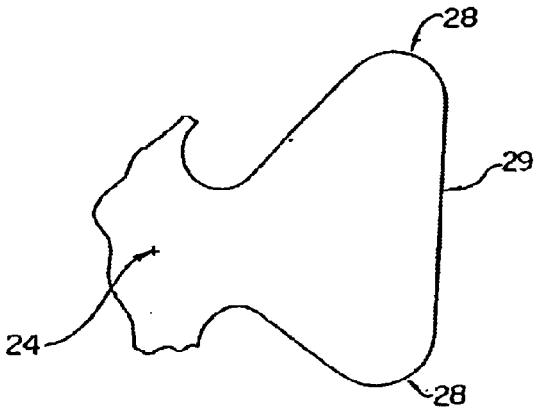

FIG. 15*b*: Detail of the rib of a cell exhibiting at least three sides.

Figure 16:
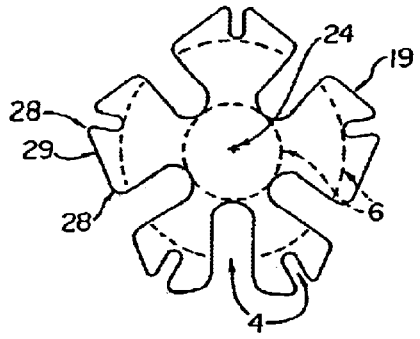

FIG. 16: Cross section of the side walls of the body of a cell in its natural state whose external envelope is roughly pentagonal, featuring ten crevices, five of which are on the sides of the pentagon, the five others being on the apexes of the pentagon, and two concentric inner perimeters, and featuring at least as many flat segments on the outer perimeter as there are crevices.

Figure 17:
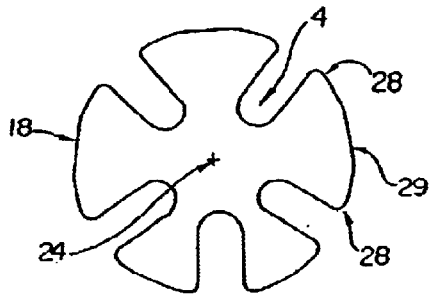

FIG. 17: Cross section of the side walls of the body of a cell in its natural state whose external envelope is roughly circular, featuring five crevices and at least as many flat segments on the outer perimeter as there are crevices.

Figure 18:
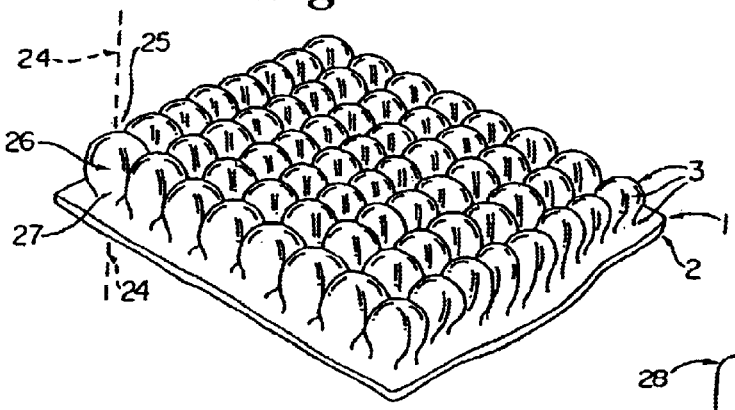

FIG. 18: Bird's eye view of a support consisting of an upper sheet made of roughly identical expansible cells, such as those shown on FIGS. 6, 7, 9, 10 and 11, attached to a lower sheet.

Figure 19:
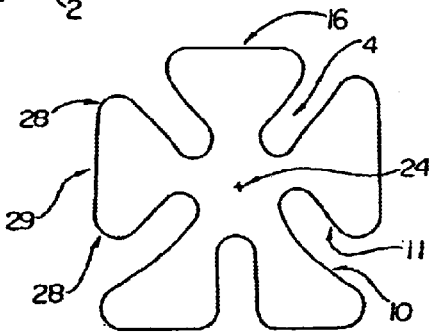

FIG. 19: Cross section of the side walls of the body of a cell in its natural state whose external envelope is roughly square, featuring five crevices, two crevices being located on the half diagonal lines of the square, at the end points of a given side, one crevice being located at the midpoint of the side opposite to the side between the two crevices on the half diagonal lines, the last two crevices being located on the outer envelope, roughly at the two-third point on the last two sides, between the first three crevices, these two crevices presenting each a concave wall and a convex wall, said cell featuring at least as many flat segments on the outer perimeter as there are crevices.

Figure 20:
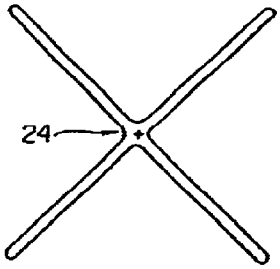

FIG. 20: Cross section of the side walls of the body of a cell in its natural state with four branches, each branch ending at the corner of a square according to previous art and in which the ribs are as fine as possible.

Figure 21:
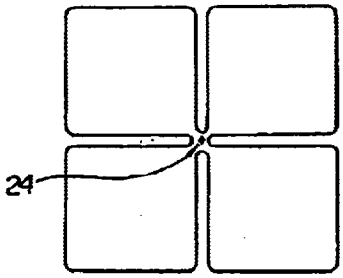

FIG. 21: Cross section of the side walls of the body of a cell in its natural state whose external envelope is roughly square, featuring four crevices on the four sides of the square, these crevices being as narrow as possible, and featuring at least as many flat segments on the outer perimeter as there are crevices.

This invention pertains to the design of mattresses, cushions, padding for medical use, reusable packaging for fragile items and dampening support.

One creates a support or padding which consists of an upper sheet 1, generally flexible and formed as needed, consisting of expansible cells 3 which can be interconnected and which can expand when filled with a fluid, characterized by the fact that the cross section of the body of a cell in its natural state is delimited by at least two partially virtual perimeters, inner 6 and outer 7, which are concentric and inscribed on envelopes of various shapes, square 16, pentagonal 19, octagonal 17, circular 18, irregular 15 and 20, where the slits, crevices or cracks are mostly created by more or less closely spaced side walls, which are parallel 4 or not, with draft 8 or against draft 9, straight 21, concave 10, convex 11 or in the form of jagged lines 12*a* and 12*b*, which connect the outer perimeter 7 to the inner perimeter 6. Without any limitative intent, the use of a jagged line 14 to connect to a point 22 on the perimeter 7 to a point 23 of the center area 6 more or less near the axis 24 of the balloon or cell (FIG. 3/FIG. 2/FIG. 1) offers a definite advantage in that the part of the cell side wall connecting two points located on separate concentric perimeters 6 and 7 can be a definite straight line on its centripetal path if, between two other points 28 being the same as the first one located on the outer perimeter 7 at the junction or exit point from a crevice. All the points on the flat section 29 are further away from the center 24 of the cell than the other points which are not on the flat section 29 and form the envelope 7 on its path between two points 28 located at the junction of successive crevices 4.

One sees (FIG. 1) a shaped upper sheet 1, made of inflated cells 3. Having cells rigidly attached to each other via sheet 1 offers all kinds of benefits to the fabrication process. The sheet 1 being assembled with sheet 2 (FIG. 18), it is nevertheless sometime possible to assemble a single cell or a cluster of interconnected cells originating from a sheet 1 on sheet 2 independently from the rest of the support.

The perimeter of the cell being equal to the sum of the apparent lengths of the exterior on the sides of the concentric sheaths plus the lengths repeated as many times of the walls of the fissures connecting these concentric sheaths. The shape of the cells as described in the present invention is characterized by the fact that unlike the cells known in the prior art and which comprise branches in straight lines (FIG. 4*b*) the cells purpose of the present invention possess walls whose sides have a wider surface (FIG. 15*b*) and which show slits, clefts or fissures.

As described in the prior art a cell 3 (FIG. 1 and FIG. 18) comprises from apex to bottom along the longitudinal axis 24 an apex 25 in the shape of a dome or a cupola when the cell is filled with fluid and when the cell is in a resting state the walls on the exterior sheath generally rejoin gently the central point of that apex preferably situated along the longitudinal axis: a body 26 purpose of the invention, a base 27 of indifferent shape, uniform or not with the body in a resting state, one may for example have a cell body 26 in a square section (FIG. 6) and a base 27 in a round, octagonal or square section, of a greater or smaller size in height and width. The bottom of the fissures of a cell in a resting state generally rejoin gently the exterior wall 7 above the joined plane of sheets 1 and 2 so as to also allow for the expansion of the fissures at that level.

According to the invention, fissures possess walls perceptibly more or less close, parallel or perceptibly 4, concave 10, convex 11, broken 12*a* and 12*b* the walls of the fissures are not necessarily symmetrical in relation to the sagittal plane of the fissure (FIG. 3) and are not necessarily radiad (FIG. 19). According to the invention and the description of the fissures, the cell's wings and branches are comprised and defined between two contiguous and successive fissures as we shall define them later; they are at a minimum triangular in shape generally, but can also be quadrilateral (FIG. 5) or other, with an interior apex. One must note that Graebe in U.S. Pat. No. 4,005,236 and U.S. Pat. No. 5,052,068 described shapes of cells with several wings uncommon and not defined outside notably of what results from his invention described in U.S. Pat. No. 4,541,136 and described again for parties in U.S. Pat. No. 5,052,068; Roux in his application FR 95/08972 described different forms one after another without being able to describe them as in the present invention in a global manner and the irrefutable differences in relation to the prior art.

By comparison with the products known in the prior art, where the first (FIG. 2) is described as a star formed of eight branches 5 joined to a central virtual element 6 and contained in an exterior sheath 7 and the second (FIG. 4*a*) as a star with four branches ending at the four corners of a squared sheath, one sees that from the distal extremity of the branches to the proximal part the walls of the branches 5 are in a straight line 13. The advantage of the present invention by comparison is in the replacement of these straight walls (FIG. 2, FIG. 4*a*, FIG. 12), the straight line being the shortest path from one point to another, by longer cell walls for example in a jagged line 14 between points 22 and 23 located each on one of the concentric perimeters 7 and 6, portions of the cell walls which follow in their centripetal path the path of the exterior sheath and shown in their distal path on at least a part of the exterior sheath 7 between the two points 28 and a flat part 29 (FIG. 4*b*) and in their proximal path slits or fissures 4 between two contiguous parts of proximal walls of said portions of the walls, fissures 4 with walls more or less perceptibly closer whose sagittal plan is here radial on the path of these jagged line 14, in the proximity of the center 24 named proximal path, the sagittal plane of a fissure is the plane located generally at mid point between the posing walls of a fissure as we shall see further on this plane is not necessarily radial. One sees that according to the invention the gain in perimeter of the cell inflated with fluid is perceptibly from 10% to 25% in practice, and as much as 40% in theory as we shall demonstrate further on, in the case of a cell presenting a section with four fissures on the lateral sides (FIG. 5) having wings with several sides in relation to a cell in the shape of a cross (FIG. 4*a*) having wings with two sides, just like a star with eight branches (FIG. 2) has a perimeter which is inferior to a cell with eight fissures (FIG. 3). The process is identical between a star with five branches (FIG. 12) in a relation to a pentagon with five fissures (FIG. 13). In theory considering that FIGS. (20) and (21) represent the section of cell bodies inscribed in squared sheaths of the same dimension as in examples pushed to the extreme in representations of FIGS. (4*a*) and (5) respectively where the wings are as thin as possible and the fissures the narrowest: knowing that "d" is the length of half of the diagonal of the square in the case of a cell meeting the criteria of FIG. (20) the perimeter of the cell would be eight times "d", in the case of a cell meeting the criteria of FIG. (21) the perimeter would be equal to sixteen times "d", which is divided by the square root of two if the square root of two is perceptibly equal to the fraction seven fifths, the theoretical perimeter of the cell (FIG. 21) would be approximately eleven and a half times "d". Consequently, the theoretical perimeter of the cell in FIG. (21) is superior by about 40% to that of the cell in FIG. (20), more simply by comparing the wings or branches (FIG. 4*a*) in the prior art and the ones (FIG. 15*b*) according to the invention, the supplement in length according to the invention is perceptibly the difference between the lengths of the exterior side (FIG. 15*b*) and the thickness of the wing in the prior art (FIG. 4*b*), in the case where the thickness of the wing is very low or in the case of a wing is very low or in the case of a wing with parallel walls (FIG. 4*b*) the presence of a flat part 29 according to the invention on perimeter 7 concerning this wing indicative of the given advantage. Graebe at first in his first patents and then in U.S. Pat. No. 4,541,136, followed by Benguigui in U.S. Pat. No. 5,553,220 described cells whose wings have parallel walls and also depression notably lateral in the case of cells with four branches all of them possessing, for Graebe as well as for Benguigui, an axis of symmetry and at least two planes of symmetry, the cell described in U.S. Pat. No. 4,541,136 (FIG. 4*a*) itself having four planes of symmetry. In all cases, the wings with parallel walls induce depression which can never themselves possess parallel walls, although already in request Fr/9508972 the disposition of the wings and of the fissures allows that the walls of a same fissure could be parallel for all the fissures of the cell. However, in the case of cells possessing very many wings or of a very small dimension, the practical need to smooth down the rough angles protruding notably at the level of the exterior perimeter 7 requires of one to specify the difference and the advantage of the present invention. According to the invention the space included between two points 28 and two fissures 4 in succession on the exterior perimeter 7 must imperatively include a flat part 29 (FIG. 4*b*) (FIGS. 3, 5, 6, 7, 8, 9, 10, 11, 12, 13, 14, 15, 16, 17, 19, 21). As an example for FIG. (4*b*) which one considers the flat part 29 as a tangent or as a cord in relation to the exterior limit of the prior art between two points 28 does not create any problem in the framework of the present invention since whatever the shape of a cell may be one must take into account only its real sizes at the starting point either the sizes and volume empty in a resting state, it appears that for size outside all of a given cell according to the prior art and the dimensions outside all according to the invention, it is according to this latter invention that the volume contained in a cell in a resting state is the most important, according to the invention, all the points constituting a flat plane 29 on the tract of the exterior sheath 7 between two points 28 at the junction of two successive fissures 4 are further away from the center 24 than the other points of the sheath 7 between the points 28 not constituting of a straight line or flat part 29.

The accomplishment of the invention allows one to see during the expansion of a cell beyond its resting position and therefore by the increase in the perimeter of the cell to obtain a decrease in the density of the cells per surface unit of support while keeping an optimum efficiency—having consequently as an advantage a gain in matter, energy such that for the drying, polymerization, vulcanization, by a better venting of the upper sheet generally obtained by dipping of the mandrels or male molds in a dip of liquid matter: latex, polyvinyl-chloride or other, which will coat them with uniform matter, which could be a very important gain particularly when the support cells such as mattresses possess heights ranging from 10 to 40 centimeters and consequently: time for the production of the upper sheet and generally all of all of these advantages plus, for the assembly of the upper sheet in its form and of the lower sheet to obtain the finished product, by the presence of plane joints of a greater surface area, due to the larger spacing of the cells of the two contiguous rows due to the invention and consequently a better assembly of sheet 1 and 2. According to a preferred example in realization, one sees (FIG. 18) a support made of an upper sheet where the cells 3 are placed and a lower sheet 2, the flat base (FIG. 1) or shaped (FIG. 18) (to be eventually laid itself on a foundation in place made of semi rigid polyurethane foam for example) and made of the assembly of sheets 1 and 2; one can also as in some cases in the prior art make supports composed of two sheets of the shape 1, the first one keeping the upper position (FIG. 1) and the second one being reversed so that the apexes 25 of its cells be down and base 27 at the apex, all of it presenting a symmetry in relation to the plane joint: one can also depending on the support remove cells of the sheet of shape 1 as to leave an empty space between the remaining cells or any other exploitable combination in cell height. The communication system between the cells being indifferent and known by the prior art.

According to the preferred examples of the best mode of realization all of the sharp angles protruding and on the cells and therefore the shape of the molds used in their manufacture will be blunted or rounded off.

The walls of the fissures can be parallel 4, with draft 8 or counterdraft 9, in a straight line 21, concave 10, convex 11, or even jagged 12*a* and 12*b*. The distribution of the fissures between the concentric perimeters, with a minimum number of two, can be random, that is to say that a fissure with walls in the shape of a jagged line can be contiguous with a fissure with parallel walls.

According to the best methods of realization the exterior virtual sheath 7 outside or irregular section shapes will possess in order of preference a square section 16 or rectangular, circular 18, pentagonal 19, octagonal 17.

The number of fissures is limited by their width at the level of the interior concentric perimeter, by the thickness of the wings at that level and by the length of the interior concentric perimeter. The greater the number of fissures, the more this allows to meet the objective of the density of cells per unit of surface of support, however for purposes of realization and manufacture of the supports or padding for medical use we can limit the number of fissures as described further on. In the extreme case where a cell would have very many wings, the difference between the prior art and the invention is demonstrated as follows.

According to the invention the schematic shape of the wing of a male mandrel being used for the manufacture of cells by soaking far example, and consequently this cell wing in a resting state is the part between two successive or contiguous fissures, and often shown as a triangle (FIG. 3) (FIG. 6) (FIG. 7) (FIG. 9) (FIG. 10) (FIG. 11) (FIG. 15*a*) (FIG. 17) or by a shape perceptibly triangular whose apex is located on the side of the interior sheath and the base on the side of the exterior sheath. We say that according to the invention a cell's wing in a resting state possesses at least three sides with at least two sides coming each from the walls of the two successive fissures and at least are side following the path of the exterior sheath, this third side possesses at least a flat part 29 on part of its path along the exterior sheath 7.

The cells meeting the description of FIGS. (6)-(7)-(9)-(10)-(11) would be more efficient by corner expansion according to the diagonals by avoiding support cavities at the intersection of the intercellular rows, offering therefore a most uniform surface of support; these rows correspond to the assembly zones (gluing, seam or other) of the upper sheets 1 and lower ones 2.

The external virtual sheath 7 for supports against bedsores can have a transverse section of about ten to one hundred millimeters, the walls of the fissures can be about two to twenty millimeters apart, the thickness of the wall of a cell can vary from half to about two millimeters. One can have as a support against bedsores or a padding an even number of fissures between about four, eight, ten, the central longitudinal axis could be an axis of symmetry. One can have as a support against bedsores or a padding an odd number of fissures between at least three and approximately nine, the eventual plane of symmetry going by the central axis. One can note that it is absolutely not necessary to have symmetry in the cells for better efficiency of the support.

As one can understand the invention can be adapted to all shapes of cells, of which we retain mainly and for the purpose of example, cells having a flat part 29 between two fissures 4, therefore at a minimum as many flat parts 29 as fissures 4.

The cell in its resting state whose section of body 26 one sees in a transverse section (FIG. 3) of the walls, the irregular external sheath 7 perceptibly circular 15 for one half semi octagonal for the other possessing eight fissures of different shapes, one fissure between both halves made of a straight wall 21 and the other convex 10 and at the opposite in relation to the center 24 of a fissure 24 made of a straight wall 21 and one convex 11 these first two fissures presenting a counter draft, half-way between the first two fissures on the semi octagonal side of a fissure with straight walls 21 with draft, on the opposite side of fissure with straight walls 21 with counter draft, between the first fissure named and the fissure with the straight walls and draft a fissure with a straight wall 21 and the other one in an jagged line 12*a* opposite a fissure with a straight wall and the other angled 12*b* between the second fissure named and the fissure with straight walls and draft a fissure with straight walls 21 perceptibly parallel 4 and on the opposite a fissure with a straight wall 21 and the other concave 10, the cell possessing a flat part 29 between two fissures 4, therefore at a minimum as many flat parts 29 as fissures 4.

The cell in s resting state whose section of the body 26 one sees in a transverse section (FIG. 14) of the walls, with external sheath 7 irregular perceptibly pentagonal 20 possessing five fissures 4 with walls perceptibly pentagonal 20 possessing five fissures 4 with walls perceptibly parallel on the five lateral sides of this pentagon, three sides being in the shape of a continuous are on three section located between four fissures, the two other sides being flat the cell possessing a flat part 29 between two fissures 4, therefore at a minimum as many flat parts 29 as fissures 4.

The cell in a resting state whose section of the body 26 one sees in a transverse section (FIG. 6) of the walls, with external sheaths 7 perceptibly squared 16 possessing four fissures 4 with walls perceptibly parallel on the diagonals of that square, the cell possessing a flat part 29 between two fissures 4, therefore at a minimum as many flat parts 29 as fissures 4.

The cell in a resting state whose section of the body 26 one sees in a transverse section (FIG. 7) of the walls, with external sheath 7 perceptibly squared 16 possessing four fissures 8 on the diagonals of that square, the fissures having walls which are not parallel are under at the distal extremity of the fissure or draft, the cell possessing a flat part 29 between two fissures 4, therefore at a minimum as many flat parts 29 as fissures 4.

The cell in a resting state whose section of the body 26 one sees in a transverse section (FIG. 8) of the walls, with external sheath 7 perceptibly octagonal 17 possessing eight fissures 4 with walls perceptibly parallel on the eight lateral faces of this octagon and two internal concentric perimeters, each proximal extremity or bottom of successive fissures ending alternatively at the level or each internal concentric perimeter, the cell possessing one flat part 29 between two fissures 4, therefore at a minimum as many flat parts 29 as fissures 4.

The cell in a resting state whose section of the body 26 one sees in a transverse section (FIG. 9) of the walls, with external sheath 7 perceptibly circular 18 possessing four fissures 4 perceptibly parallel, the cell possessing a flat part 29 between two fissures 4, therefore at a minimum as many flat part 29 as fissures 4.

The cell in a resting state whose section of the body 26 one sees in a transverse section (FIG. 10) of the walls, with external sheath 7 perceptibly squared 16 possessing four fissures 9 on the diagonals of that square, the fissures having walls which are not parallel are wider at the proximal extremity of the fissure or bottom or counter draft, the cell possessing a flat part 29 between two fissures 4, therefore at a minimum as many flat parts 29 as fissures 4.

The cell in a resting state whose section of the body 26 one sees in a transverse section (FIG. 11) of the walls, with external sheath 7 perceptibly circular 18 possessing four fissures 8 with draft, the cell possessing a flat part 29 between two fissures 4, therefore at a minimum as many flat parts 29 as fissures 4.

The cell in a resting state whose section of the body 26 one sees in a transverse section (FIG. 13) of the walls, with external sheath 7 perceptibly pentagonal 19 possessing five fissures 4 with walls perceptibly parallel on the five lateral sides of this pentagon at an equidistant of the extremities on each side, the cell possessing a flat part 29 between two fissures 4, therefore at a minimum as many flat parts 29 as fissures 4.

The cell in a resting state whose section of the body 26 one sees in a transverse section (FIG. 14) of the walls, with external sheath 7 irregular perceptibly pentagonal 20 possessing five fissures 4 with walls perceptibly pentagonal 20 possessing five fissures 4 with walls perceptibly parallel on the five lateral sides of this pentagon, three sides being in the shape of a continuous are on three section located between four fissures, the two other sides being flat the cell possessing a flat part 29 between two fissures 4, therefore at a minimum as many flat parts 29 as fissures 4.

The cell in a resting state whose section of the body 26 one sees in a transverse section (FIG. 15*a*) of the walls, with external sheath 7 perceptibly squared 16 possessing five fissures 4 with perceptibly parallel walls two fissures of which are located at the level of the superior angles of that square, two other on the lateral sides of the square and at two thirds of these sides closer to the base of the square and the fifth one at the middle of the base of the square, the cell possessing a flat part 29 between two fissures 4, therefore at a minimum as many flat parts 29 as fissures 4.

The cell in a resting state whose section of the body 26 one sees in a transverse section (FIG. 16) of the walls, with external sheath 7 perceptibly pentagonal 19 possessing ten fissures 4 five of the fissures on the five lateral sides of this pentagon, the other five at the five apexes of this pentagon and two internal concentric perimeters, the bottom of the contiguous fissures ending at the level of each perimeter or internal sheath, the cell possessing a flat part 29 between two fissures 4, therefore at a minimum as many flat parts 29 as fissures 4.

The cell in a resting state whose section of the body 26 one sees in a transverse section (FIG. 17) of the walls with external sheath 7 perceptibly circular 18 possessing five fissures 4 with walls perceptibly parallel, the cell possessing a flat part 29 between two fissures 4, therefore as many flat parts 29 as fissures 4.

The cell in a resting state whose section of the body 26 one sees in a transverse section (FIG. 19) of the walls with external sheath 7 perceptibly squared 16 possessing five fissures 4 with walls perceptibly parallel of which two fissures with straight walls are located at the level of the superior angles of that square, two other on the lateral sides of the squares and at the second third of the length of these sides closer to the base of the square, the bottom moving aside from the center of the cell in the direction of the bottom of the first two contiguous fissures each fissure possessing a concave wall 10 and the other one convex 11 parallel 4 and the fifth fissure with straight walls 4 at the middle of the base of the square, the cell possessing a flat part 29 between two fissures 4, therefore at a minimum as many flat parts 29 as fissures 4.

According to the invention, the implementation of these supports can therefore apply to the realization of the mattress, pillows, padding against bedsores, but also such as a mattress involved in the comfort of an individual, pillows, back rest and as padding or protection for fragile items, the description of the advantage given by the invention is not restrictive of the process of obtaining the manufactured product with mandrels or male molds by soaking as preferred to female molds for reasons of finishing work of the surface of the molds, mold against mold by injection, mold for rotomolding, thermoforming or other processes.

The fact remains, of course, that the present invention is not limited to the above-mentioned examples of realization described and represented thus but that it includes all of its variations.

What is claimed is:

1. Support padding including a plurality of expandable cells, at least a first one of the plurality of expandable cells having a wall forming first and second branches in a transverse section of an external sheath of the first cell in a resting state, the first and second branches separated by first and second slits, the first branch comprising first and second walls of the first and second slits, respectively, the first and second walls being divergent away from a center of the cell such that at least a third wall joins the first and second walls, the third wall being along an outer perimeter of the wall of the cell.

2. Support padding according to claim 1 wherein the external sheath is perceptibly pentagonal possessing five slits with perceptibly parallel walls on the five lateral sides of this pentagon, three of the sides being in the shape of an arc, continued on three sections located between four slits, two of the sides having a flat part between two slits, therefore at a minimum as many flat parts as slits.

3. Support padding according to claim 1 wherein the external sheath is perceptibly circular possessing five slits with walls perceptibly parallel, the cell possessing a flat part between two slits, therefore at a minimum as many flat parts as slits.

4. Support padding according to claim 1 wherein the transverse section shows branches of said cell which possess at least three sides with at least two sides each stemming from the walls of two successive slits characterized by the fact that these two sides are never parallel for the totality of the branches of the cell and that the third side comprising the third wall follows a path of the external sheath and possesses at least a flat part along part of a tract of the third side, each part of this flat part being further away from the center of the cell than the other parts of that third side.

5. Support padding according to claim 1 wherein the external sheath is perceptibly square and includes four slits with perceptibly parallel walls on diagonals of that square.

6. Support padding according to claim 1 wherein the external sheath is perceptibly square and includes four slits on diagonals of that square, the four slits each having non-parallel walls separated more at the distal extremity of the slits from the center.

7. Support padding according to claim 1 wherein the external sheath is perceptibly square and includes four slits on diagonals of that square, the four slits each having non-parallel walls separated more at the proximal extremity of the slits from the center.

8. Support padding according to claim 1 wherein the external sheath is perceptibly squared and includes five slits with walls perceptibly parallel, two of these slits being located at superior angles of that square, two other of these slits being located on two lateral sides of the square at the second third of a length of these two lateral sides closer to a base of the square and the fifth slit being located at the middle of the base of the square.

9. Support padding according to claim 1 wherein the external sheath is perceptibly squared and possesses five slits with walls perceptibly parallel, two of the five slits being located at a level of superior angles of the square, two other of the five slits being on lateral sides of the square and at the second third of a length of the lateral sides closer of a base of the square, the two other of the five slits having a concave wall and a convex wall, respectively, and a fifth slit of the five slits being at a middle of the base of the square.

10. Support padding according to claim 1 wherein the external sheath is perceptibly pentagonal and possesses five slits with perceptibly parallel walls on five lateral sides of the pentagon shape, the five slits being equidistant of extremities on each side.

11. Support padding according to claim 1 wherein the external sheath is perceptibly octagonal and possesses eight slits with perceptibly parallel walls on eight lateral sides of the octagon and two internal concentric perimeters, a bottom of successive slits ending alternatively at the two internal concentric perimeters.

12. Support padding according to claim 1 wherein the external sheath is perceptibly circular for a first half and octagonal for a second half, the first one of the expandable cells possessing eight slits of at least two different shapes, the first and second slits separating the first and second halves, the first and second slits each having a straight wall and a convex wall, a third slit half way between the first and second slits on the octagonal second half having straight walls with draft, a fourth slit opposite the third slit having straight walls with counter draft, a fifth slit between the first and fourth slits, the fifth slit having a straight wall and a wall comprising an angled line, a sixth slit opposite the fifth slit having a straight wall and a jagged wall, a seventh slit between the second slit and the third slit, the seventh slit having a perceptibly parallel straight walls, and an eighth slit opposite the seventh slit, the eighth slit having a straight wall and a concave wall.

13. Support padding according to claim 1 wherein the external sheath is perceptibly pentagonal and possesses ten slits, five of the ten slits on five lateral sides of the pentagon, the five other of the ten slits on five apexes of the pentagon, bottoms of the ten slits ending alternatively at first and second, different inner perimeters.

* * * * *